US006640868B1

(12) United States Patent
Guggisberg

(10) Patent No.: US 6,640,868 B1
(45) Date of Patent: Nov. 4, 2003

(54) WEATHER PROTECTION DEVICE COMPRISING AT LEAST ONE FOLDABLE PROTECTIVE ELEMENTS

(76) Inventor: Urs Guggisberg, Oberdorf 115, 4584 Lüterswil (CH)

( * ) Notice: Subject to any disclaimer, the term of this patent is extended or adjusted under 35 U.S.C. 154(b) by 0 days.

(21) Appl. No.: 10/088,844

(22) PCT Filed: Aug. 15, 2000

(86) PCT No.: PCT/CH00/00432

§ 371 (c)(1),
(2), (4) Date: Mar. 21, 2002

(87) PCT Pub. No.: WO01/23692

PCT Pub. Date: Apr. 5, 2001

(30) Foreign Application Priority Data

Sep. 24, 1999 (CH) ..... 1745/99

(51) Int. Cl.[7] ..... E06B 9/06
(52) U.S. Cl. ..... 160/84.07; 160/53
(58) Field of Search ..... 160/84.07, 134, 160/53; 135/117, 98

(56) References Cited

U.S. PATENT DOCUMENTS 345,183 A * 7/1886 Smith ..... 160/53
462,324 A * 11/1891 Newton ..... 160/53
1,512,252 A * 10/1924 Verduin ..... 160/84.07 X
3,298,422 A * 1/1967 Ruiz ..... 160/134 X
3,386,455 A * 6/1968 O'Rear ..... 160/134 X

FOREIGN PATENT DOCUMENTS

| | | |
|---|---|---|
| AU | 0618046 | 7/1989 |
| CH | 0468864 | 4/1969 |
| WO | 9838400 | 9/1998 |

* cited by examiner

*Primary Examiner*—David Purol
(74) *Attorney, Agent, or Firm*—Sidley Austin Brown & Wood, LLP

(57) ABSTRACT

A weather protection device including at least one foldable protection component having a plurality of shafts and a none-circular trapaulin attached to one of the shafts, and further including a mounting device for supporting the protection component in a predetermined position and arranged in such a way that it provides for rotation of the unfolded protection component around a vertical or horizontal axis, for adjusting the height of the protection component, for setting the protection component at an angle, and/or for at least partially unfolding the tarpaulin using a take-up yoke.

12 Claims, 5 Drawing Sheets

WEATHER PROTECTION DEVICE COMPRISING AT LEAST ONE FOLDABLE PROTECTIVE ELEMENTS

BACKGROUND OF THE INVENTION

1. Field of the Invention

The invention relates to a weather protection device having at least one foldable protection component with several swivelling shafts, a non-circular trapaulin attached to one of the shafts, and an adjustable mounting device for supporting the protection component.

2. Description of the Prior Art

Such a device is known, for example, from the PCT/CH 98/000 79. In this device, the foldable protection component is in the form of a roof as well as additionally in the form of partition or sidewall, which can be attached to a foldable roof and can also be disattached. The protection component in the form of a foldable roof includes a mounting device with which the weather protection device can be attached to a vertical house wall, for example. The position of the unfolded roof relative to the mounting device and consequently to a house wall, to a terrace at least partially covered by the device or to a balcony is determined by the form and design of the mounting device.

The invention has been designed with the purpose of creating a weather protection device of the kind cited above, which can be used and adjusted in multifaceted ways.

SUMMARY OF THE INVENTION

According to the invention, there is provided a device of the type described above and in which the mounting device is designed and arranged in such a way that it is possible to rotate the unfolded protection component around a vertical axle or horizontal axles to adjust the height of the protection component, set the protection component at an angle, adjust the protection component traversely around an axle provided for this in the middle between the outer shafts, and/or at least partially unfold a tarpaulin using at least one takeup yoke.

The mounting device has been designed in such a fashion in the device that it is possible to turn the unfolded protection component on a vertical or horizontal axle, adjust the height of the protection component and/or open out the protection component using at least one takeup yoke. This makes it possible using the invented device, for example, to adjust the protection component corresponding to the position of the sun, so that the device provides the user optimal protection against intensive sunrays or gusts of wind. The at least partial opening of the protection device provides a multifaceted adjustment of the area to be protected by the protection component to the conditions desired by the user, so that protection against the sun, for example, is only provided at the spaces necessary for this, but so that the sun's rays are not prevented from reaching the inside of an apartment because the area of the protection device is too large. This makes it possible, for example, to protect plants from too intensive sunrays and at the same time to allow bright, incoming light at places where protection against the sun is not required.

As an additional advantage, the mounting device has an adjustment mechanism and a linked node component that can be swiveled at the end of each shaft, whereby the adjustment mechanism can be rotated, swiveled and/or moved. Consequently, central adjustment of the node component makes it possible to adjust the total protection device easily, so that the complexity of design for achieving different setting options can be kept to a minimum.

In accordance with a further development of the invention, the adjustment mechanism has at least one worm gear connected with the node component. In accordance with another further development of the invention, the adjustment mechanism has a moving mechanism connected with the node component, which is preferably a rotatable threaded rod and a nut that can be moved back and forth and which supports the node component. Additionally, such mechanisms are very sturdy, so that the lifespan of the invented device is not affected adversely by frequent adjustment of the foldable protection component.

Another advantage is that the protection component can be positioned in a horizontal or vertical position in a folded state using the mounting device independent of its position in an unfolded state. The additional development simplifies storing of the protection component, for example, under a jutting-out roof or in the lee of a drainpipe, so that the protection component is not only protected, but also inconspicuous and consequently can be stored compatible with aesthetic requirements.

In accordance with another further development of the invention, at least one takeup yoke has a joint approximately in its middle lengthways and is connected on at least one of its ends with the end of the outer shaft of the protection component in such a way that it can be swiveled. In accordance with one design of this, each respective outer end of at least one takeup yoke is connected with one of the outer shafts of the protection component. In accordance with another design of this invention, only one outer end of at least one takeup yoke is connected with one of the outer shafts of the protection component and the other outer end of at least one takeup yoke is connected with one of the other shafts, which is arranged between the outermost shaft of at least one protect component, so that the protection component can be opened up partially. At least one takeup yoke can consequently be folded together, so that the volume and consequently the dimensions of the folded weather protection device are raised only slightly by the provision of at least one takeup yoke. The inclusion of at least one takeup yoke not only simplifies opening of the protection component, but also enables it to be done quickly. Unfolding of at least one takeup yoke makes it possible to unfold the protection component of the invented weather protection device in a simple fashion.

In accordance with an advantageous further development of the invention, the mounting device has several takeup yokes, so that the protection component can be unfolded in sectors. This makes it possible to adjust the area covered by the protection component easily to the requirements of the person using the invented weather protection device.

In accordance with another further development of the invention, at least one takeup yoke preferably has an initial load in its open or closed position via a torsion spring placed around the joint. It can be moved to a position without an initial load via an adjustment device, preferably in the form of a rope hoist or a worm gear attached on the side. This greatly simplifies operation of the takeup yoke and consequently the weather protection device and makes less force necessary. The closing or opening of the protection component is practically automatic, so that only an adjustment in the direction of the position without an initial load is required for the protection component.

BRIEF DESCRIPTION OF THE DRAWINGS

Examples of the invention are described in more detail below using the illustrations.

DETAILED DESCRIPTION OF THE PREFERRED EMBODIMENTS

Figure 1:
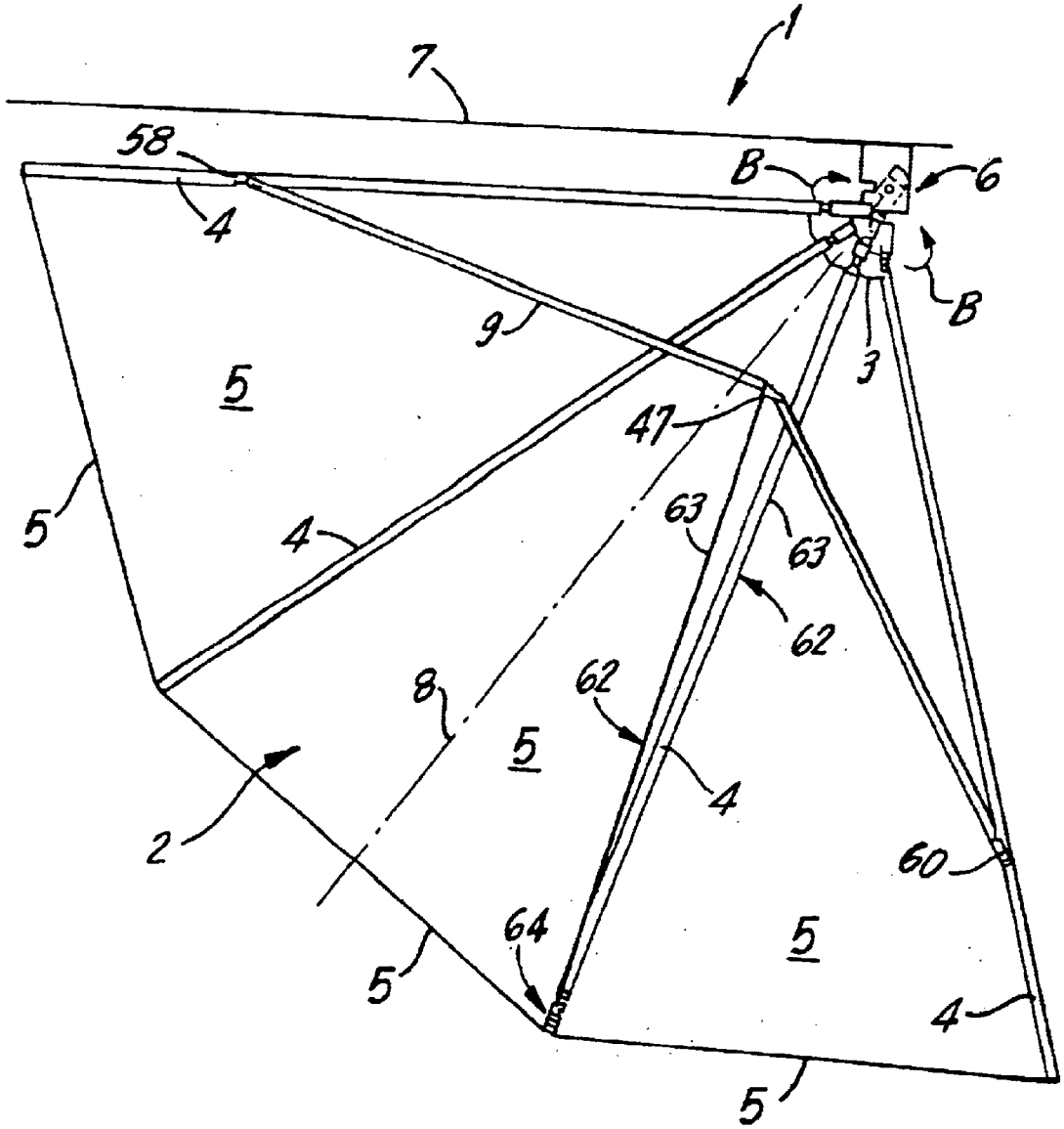
FIG. 1 A schematic, simplified view from above of a weather protection device in an unfolded state.

A schematic view from above of a weather protection device in an unfolded or folded state in accordance with the invention is shown in FIG. 1.

The weather protection device (1) includes a foldable protection component (2), which in the depicted, open state has an opening angle of approximately 105°. The protection component has four, horizontally swivelable shafts pivoted at a node component (3), a non-circularly shaped tarpaulin attached to shaft (4), which does not cover the area between the shafts, and an adjustable mounting device (6), which helps to support the protection component in its respective position and is attached to a vertical wall according to FIG. 1.

According to the invention, the mounting device (6) is so constructed and arranged that it is possible to rotate the unfolded protection component (2) on a vertical or horizontal axle, adjust the height of the protection component, adjust the slope of the protection component, swivel the protection component between an axle provided between the external shafts and/or unfold the tarpaulin at least partially using a takeup yoke (9).

Figure 2:
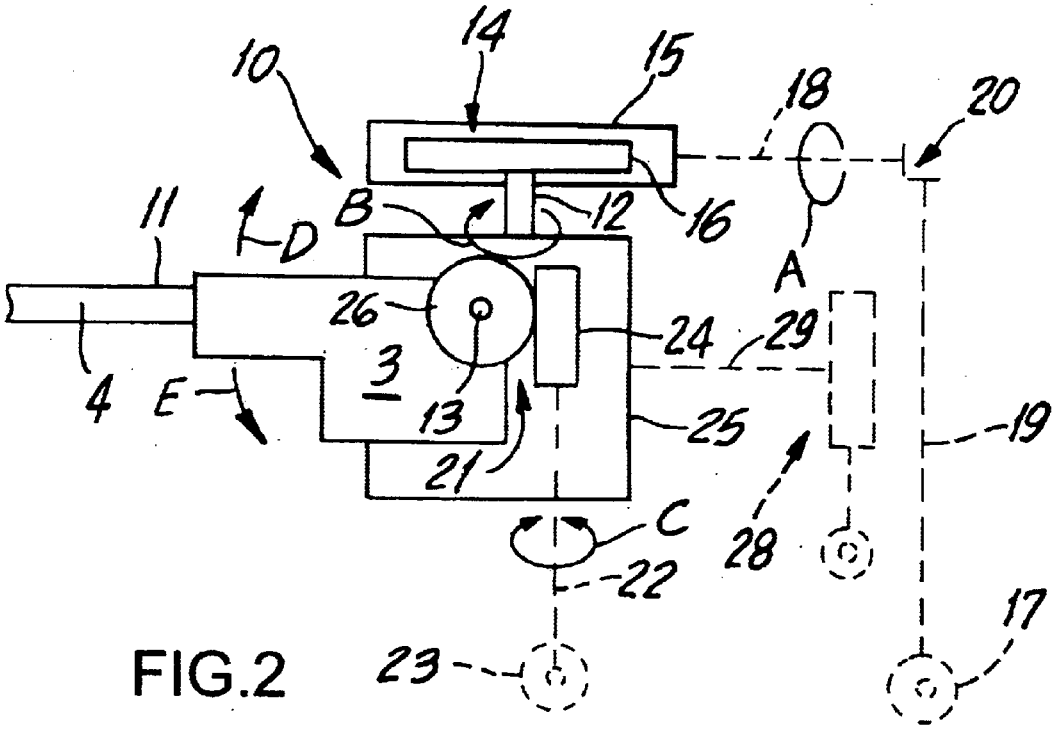
FIG. 2 A schematic, simplified side view of a mounting device with an adjustment mechanism.

Part of the mounting device (6) is depicted schematically and simplified in a side view in FIG. 2. The mounting device (6) has an adjustment mechanism (10) and a connected node component (3), in which the inner end (11) of each shaft (4) is attached so that it can be swiveled horizontally, whereby the last cited horizontal capability of the shaft to be swiveled is not displayed in FIG. 2.

The adjustment mechanism (10) is linked in such a way with the node component, that the latter can be rotated, swiveled and/or moved by the adjustment mechanism. With help of the adjustment mechanism (10) displayed in FIG. 2, it is possible to rotate or swivel the node component (3) and the protection component (2) around a vertical axle (12) and a horizontal axle (13). For swiveling the protection component (2) in an unfolded state, the adjustment mechanism (19) has a first worm gear (14) with a somewhat horizontally positioned threaded rod (15), the outer thread of which cogs with a cog wheel (16) on the vertical axle. For the purpose of providing a better illustration of the first worm gear (14), the threaded rod in FIG. 2 is displayed enlarged by a factor of 16 in comparison to cog wheel (16).

The threaded rod (15) can be rotated on a horizontal axle (18) in the direction of the double arrow A using the first lug (17), which is indicated schematically. Additionally, a vertical axle (19) is connected with the axle (18) of the threaded rod (15) via a bevel gear. This connection can be made via one or more universal joints, for example.

Rotating the lug (17) causes a rotation of the node component (3) around the vertical axle (12), i.e., in a horizontal direction, as is indicated by the double arrow B. The protection component (2) covers an opening angle between 60° and 180°, for example, in an opened state, but can be swiveled by approximately 270° via a worm gear (14) in this opened state.

A second worm gear (21) is also displayed in FIG. 2 and has a rotatable threaded rod (24) around the vertical axle (22) of a lug. The threaded rod (24) is supported on a bearing plate (25) and can be rotated. The outer thread of the threaded rod (24) cogs with a cog wheel (26), which is connected permanently with the node component (3), whereby the cog wheel (26) and node component (3) can be rotated around the horizontal axle (13), which is supported in a bearing plate (25) and can be rotated.

Rotating the axle (22) using the lug (23) in the direction of the double arrow C causes a swinging up of the node component in the direction of arrow D or a lowering of the node component (3) in the direction of the arrow E. It is clear that the shafts (4) also execute a swiveling movement due to the swiveling movement of the node component, so that the slope of the protection component (2) can be adjusted using the second worm gear (21) seen overall.

Consequently, the adjustment mechanism displayed in FIG. 2 makes it possible to rotate the unfolded protection component in a horizontal direction around the vertical axle (12) and a swiveling up or down of the protection component around the horizontal axle 13.

Figure 3:
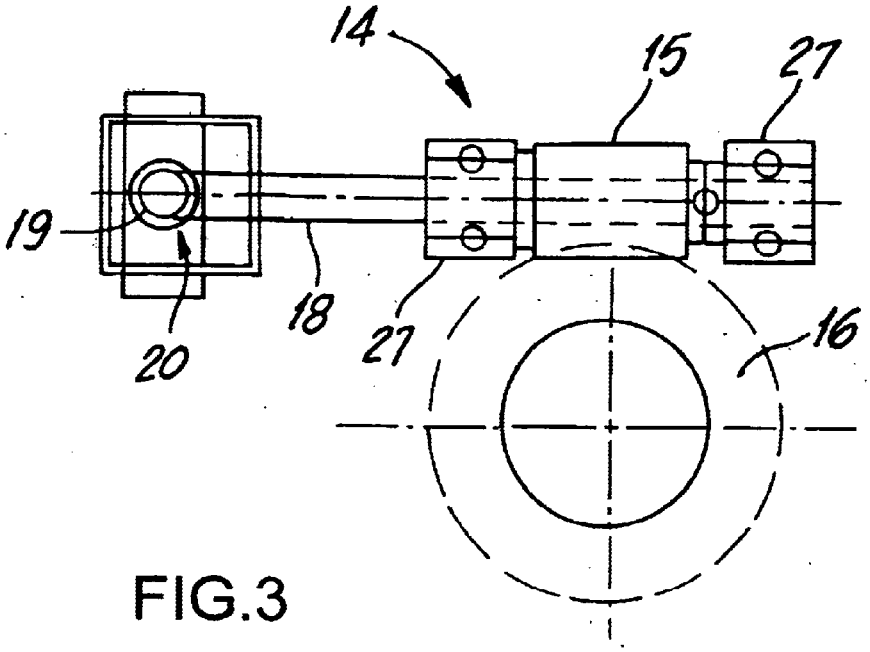
FIG. 3 A schematic, simplified view from above of a part of the adjustment mechanism according to FIG. 2.

To make the illustration clearer, the first worm gear (14) in FIG. 3 is depicted schematically in a view from above. It is clear that the threaded rod (15) is held in its position via the bearing support (27) and consequently prevents slipping out of the gearing with the cog wheel (16).

Another variant (28) of the adjustment mechanism (10) is only indicated in dotted lines in FIG. 2. This variant serves to rotate the node component (3) on another horizontal axle (29), which encloses an angle of 90° with the first horizontal axle (13), so that the complete protection component swivels around the axle (29). The axle is set at the middle between the outer shafts (4) and can be approximately on a vertical level with the axle (8) shown in FIG. 1.

In accordance with an advantageous model of the invention, another variant (28) is designed in the same way as the first worm gear (14), so that it is also possible to construct the first worm gear (14) in such a way that it—as shown in the dotted line in FIG. 2—can be inserted into the support base (25) with its axle (12) or pulled out of the base support (25) and can be connected with the base support (25) in the position of the variant (28). This model has the advantage that the first worm gear can be connected with the base support in two different positions and consequently with the node component (3). Consequently, it can rotate the node component around a vertical and a horizontal axle. Insofar, the protection component (2) can be used both in the form of a roof or umbrella as well as in the form of a vertical wall or partition. This applies especially in the latter case when the roof-shape protection component rotates around the horizontal axle (29) and consequently is moved into a vertical position.

Figure 4:
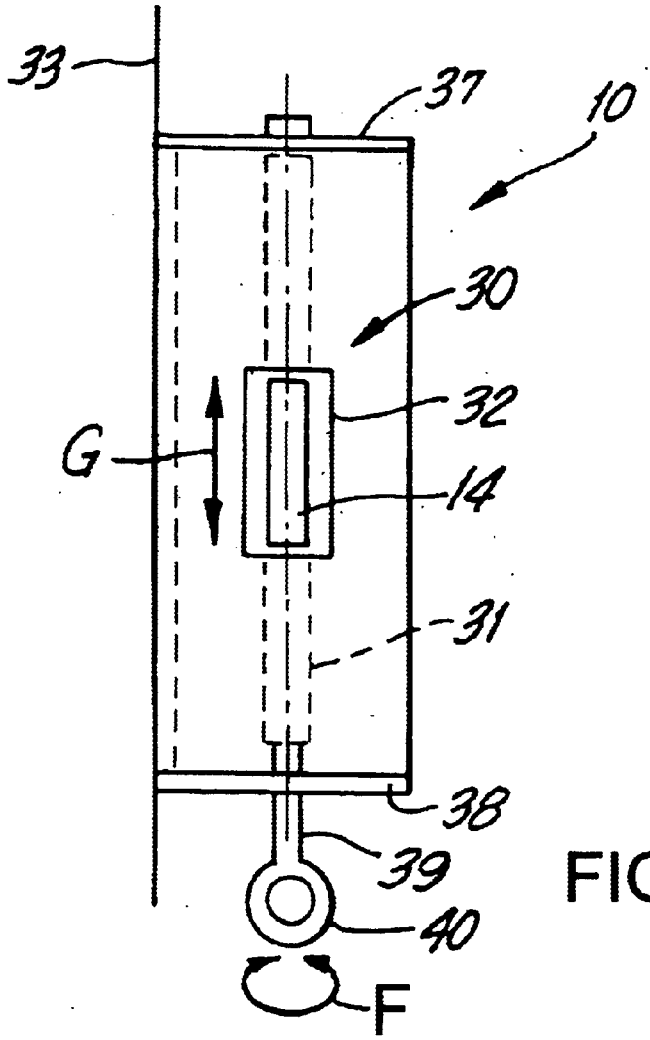
FIG. 4 A schematic, simplified side view of a mounting device with a movement mechanism.

In accordance with a preferred model of the invention, the adjustment mechanism (10) shown in FIG. 4 also shows a movement mechanism (30) in the shape of a rotatable threaded rod (31) and a nut (32), which can be moved back and forth and which supports the node component (3).

Figure 5:
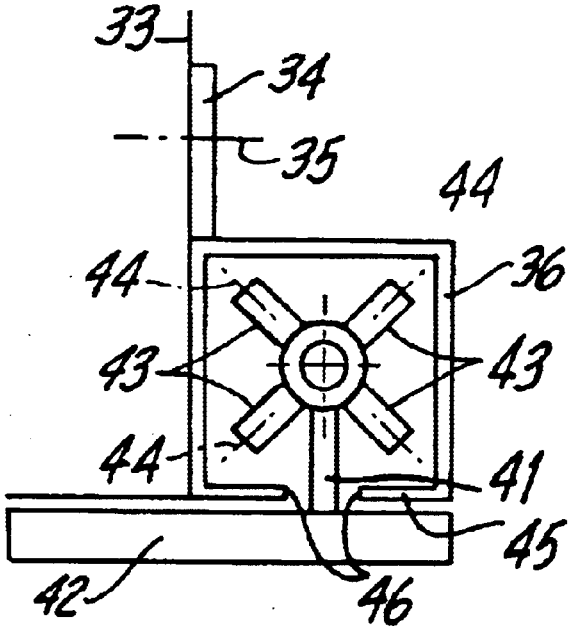
FIG. 5 A schematic, simplified view from above of a part of the approximate mechanism according to FIG. 4 without upper lid.

The movement mechanism (30) is placed on a vertical wall (33) above a mounting plate (34) with a hollow profile (36) supported by attachment means (35), as this is indicated in FIG. 4 and 5.

The mounting profile (36) has an approximately quadratic cross-section and is covered by a lid (37, 38) at its upper and lower ends, in which the threaded rod (31) or the extension of the thread rod (31) is positioned (not shown in detail) so that it can be rotated by the axle (39) of a lug (40).

The nut (32) shows a connection plate (41) on its front side visible in FIG. 4, which is connected with a receptacle plate (42) for attaching the node component (3) or additional components of the adjustment mechanism. Furthermore, holding frames (43) are attached radially to the outside of the nut in such a way that their middle level aligns approximately with the opposite corners of the hollow profile (36). To provide a better overview, the holding frames are left out in the side view in FIG. 4 and also displayed schematically in the view from above in FIG. 5. The holding frames (43) serve for the rotatable positioning of bearing rollers (44), which are constructed so that one bearing roller (44) in each of the four internal corners of the hollow profile can be rolled up and down in a vertical direction. To provide a better overview, the bearing rollers (44) in FIG. 5 are only indicated with dotted lines. Preferably, the external lateral area of the bearing rollers (44) runs convex to the middle of each bearing roller, so that the movement mechanism (30) is well supported and is placed in the hollow profile (36) so that it can be moved. A vertical slot (46) is provided to place the connection plate (41) through the front side wall (45) of the hollow profile (46).

When the lug (40) is rotated in the direction of the double arrow F, the nut (32) moves with the connection plate (41) as well as the receptacle plate (42) along the double arrow G, whereby the complete protection component (2) is designed so that its height can be adjusted. This makes it possible to reduce or increase the distance between the roof-shaped protection component and the floor.

We have indicated for the purposes of completeness that the receptacle plate (42) as well as the front side wall (45) with the vertical slot (46) in the hollow profile (36) have been left out in FIG. 4.

As previously mentioned, the invented protection component (2) can be unfolded at least partially using a takeup yoke (9). Each takeup yoke has a joint (47) approximately in its middle lengthwise, as this is indicated more precisely in FIG. 6, 8 and 9. According to the invention of the model shown in FIG. 6, the protection component (2) is constructed in the shape of a partition and encloses an opening angle of approximately 90°. The outer shaft (4) is horizontal in the side view of a balcony, and the other outer shaft is arranged vertically on a house wall (49). Consequently, this protection component is in the shape of a foldable weather or view-blocking wall. One of the outer shafts (4) is fixed permanently, whereby the other is attached in such a way that it can be loosened, so that the complete protection component (2) can be folded together when the latter is loosened.

Figure 6:
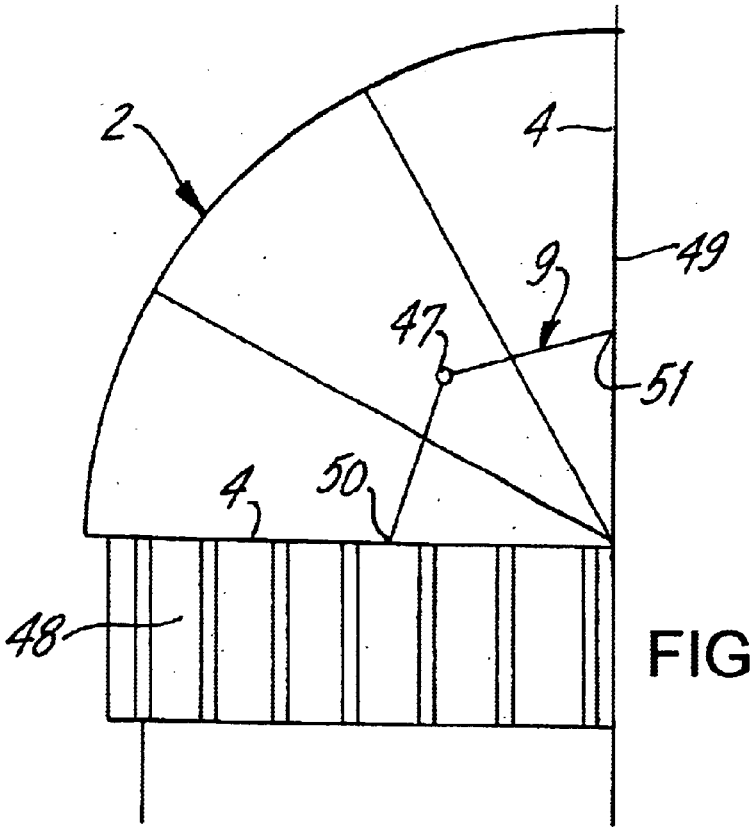
FIG. 6 A schematic front view of a vertically arranged, unfolded weather protection device.

In the view shown in FIG. 6, both outer ends (50, 51) of the takeup yoke (9) are connected with one of the outer shafts (4) of the protection component (2), so that they can be swiveled. According to FIG. 6, the protection component shown provides view and weather protection in the opening angle of 90°.

Figure 7:
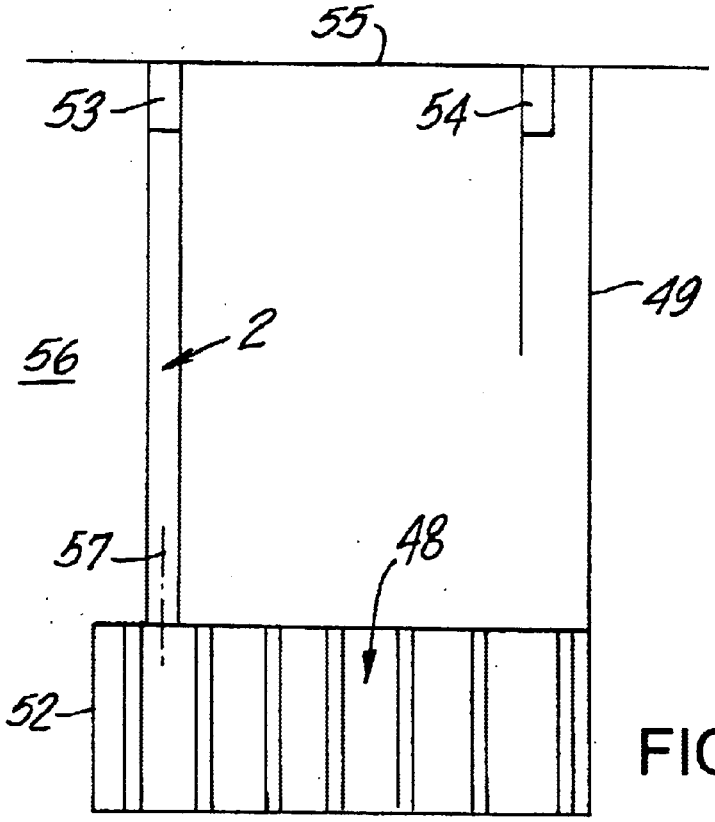
FIG. 7 A schematic side view of a vertically mounted weather protection device.

In FIG. 7, the only schematically indicated protection component is arranged close to one outer side (52) of the balcony (48) and attached to an external rafter as an example. In the shown model, the next inner rafter (54) is next to the house wall (49) or near a not-shown window. An only schematically indicated roof (55) is above the rafters (53 and 54).

The protection component shown in FIG. 7 is also vertical like that in FIG. 6, but contrary to it is arranged approximately parallel to the house wall (49). It is possible to position the not-shown node component in FIG. 7 near to the upper side of the balcony (48) or near to the lower side of the rafter (53). Consequently, the protection component shown in FIG. 7 serves preferably as a view and/or weather protection from the front (56). This protection component (2) can be constructed in such a way that it can also be used as a view and/or weather protection from the side. In the latter case, the protection component could be rotated around the swivel axle (57), for example, so that the outer ends of the shaft are directed to the house wall (49). It is clear that the length of at least the lowest, outer shaft (4) does not exceed the exposed distance between the axle (57) and the house wall (49) in the latter case.

Figure 8:
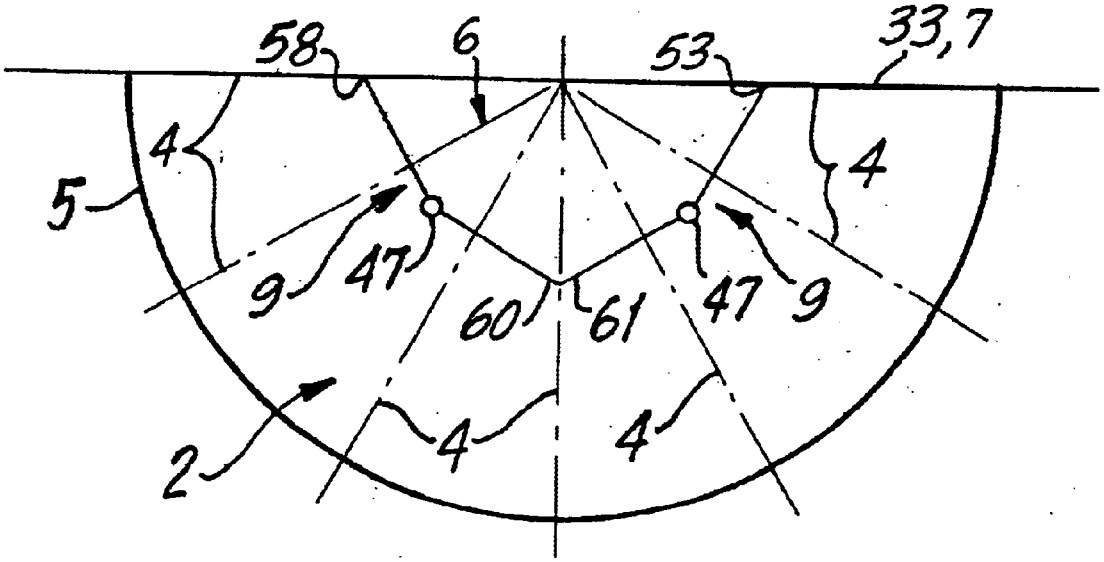
FIG. 8 A schematic view from above of an unfolded weather protection device with two takeup yokes.
Figure 9:
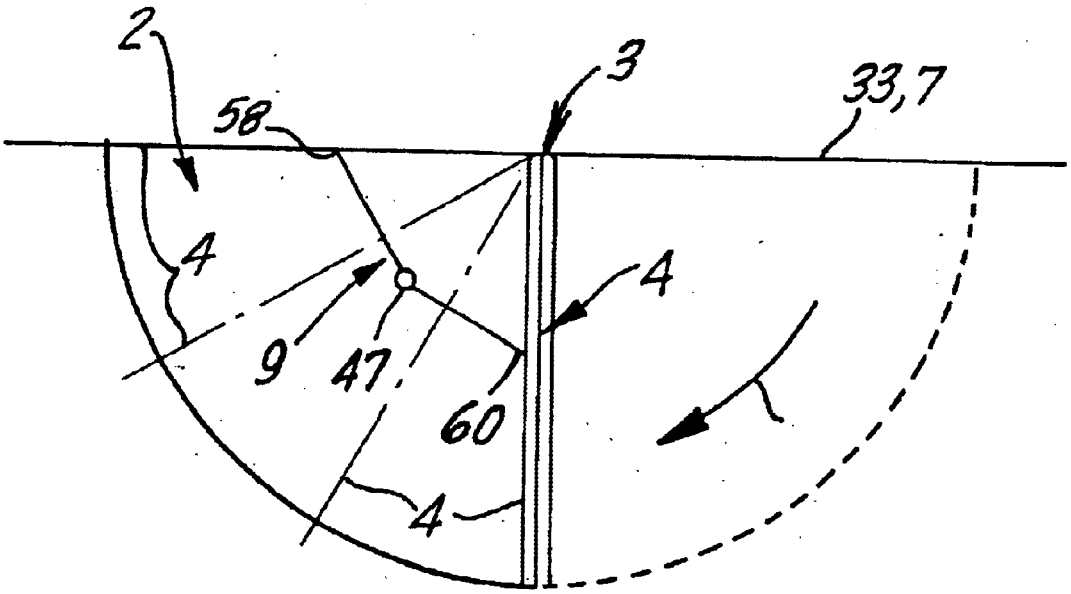
FIG. 9 A schematic view from above of a weather protection device according to FIG. 8 with a partially folded protection component.

Another model of the protection component (2) is shown in FIGS. 8 and 9, which illustrate an overhead view of a weather protection device in line with the invention. The protection device is in turn attached to a vertical wall (33), which can also be a house or garage wall, by a mounting device not shown in more detail, so that it can be adjusted. The protection device (2) shown here has an opening angle of approximately 180° and a tarpaulin (5), which is connected with seven shafts (4). The other shafts arranged between the outer shafts are only indicated by dotted lines for simplification purposes.

According to the invention, this model of the protection component (2) has two takeup yokes (9), whereby only one outer end (58, 59) of each takeup yoke is connected with the outer shaft (4) and the other outer end (60, 61) is connected with the other shaft (4), which is arranged between the outer shafts (4) of the protection component, so that the protection component (2) can be unfolded partially.

The design of the mounting device (6) with two takeup yokes (9) makes it possible to unfold the protection component (2) in sections, as is shown in FIG. 9. In this case, the shafts would be swiveled in such a way around the node component (3) in the direction of arrow H with the inner end of the right part of the protection component shown in the figure, so that they are approximately at an angle of 90° to the vertical wall (33).

In another model of the invention, a tie back not shown in more detail stows a tarpaulin hanging down from the folded together shafts, so that the visible side of the protection component is designed to be aesthetically pleasing even when the protection component is folded together completely or partially. When the protection component is folded together completely, the shafts can be swiveled parallel to the wall (33) to the right or the left in a vertical position depending on the construction of the node component and be attached to the wall in this position.

The protection component can also be adjusted in a folded state, especially with respect to height in a vertical direction using the movement mechanism, whereby the stowing of the protection component is simplified in niches, projections or recesses. Independent of its position in a folded state, it is also possible to protect the protection component (2) against meteorological influences by a sheath with a zipper, for example.

In a preferred model of the invention, each takeup yoke is preferably subject to an initial load in its open or closed position via a torsion spring not shown in more detail positioned around the joint (47). Each takeup yoke can also be moved to a position without an initial load via an adjustment device (62), preferably in the form of a rope hoist (63).

The adjustment mechanism (62) is indicated schematically in FIG. 1 and left out for purposes of clarity in FIG. 6 to 9. One end of the adjustment mechanism (62), for example the rope hoist (63), acts on the takeup yoke (9) approximately in the area of the joint (47), is turned around in the further course at the position (64) of the outer area of one of the middle shafts (4) and finally runs above the shaft to the node component (3) or the mounting device (6), where is preferably is guided vertically down with a return pulley not shown in more detail and can be fixed tight.

Each takeup yoke is preferably subject to an initial load in its closed position via a torsion spring not shown, so that the takeup yoke can be unfolded when the rope hoist (63) is pulled, which unfolds the protection component at the same time. The rope hoist (63) is fixed in the unfolded position of takeup yoke (9) and protection component (2). The folding together of the takeup yoke in done in such a way that the adjustment mechanism (62), for example the rope hoist (63), is disconnected and the takeup yoke is moved slowly into its closed position, which results in a folding of the protection component. Then the shafts (4) can be swiveled to the wall and attached to it.

In a preferred model of the invention, the outer shafts (4) are arranged above the tarpaulin and the other shafts arranged between the outer shafts are below the tarpaulin. Furthermore, the takeup yoke is arranged above the outer shafts. If there are several takeup yokes, the middle shaft is preferably above the tarpaulin too. Consequently, the adjustment device is also above the tarpaulin (5).

However, the shafts and tarpaulin can also be arranged in a different way. It is possible to arrange the shafts and the takeup yoke below the tarpaulin or—for example—to arrange the shafts for attaching the takeup yoke on one side and the takeup yoke on the other side of the tarpaulin. It is also possible to operate the respective takeup yoke with a worm gear on the side instead of with a rope hoist. This worm gear is then arranged close to one of the outer shafts (4). It is clear that the invented weather protection device can also be used to block views, especially when it is set vertically.

The protection component can be adjusted in many ways with the invented device, so that one and the same device can be adapted to many cases occurring in actual use. The device can not only be used essentially as a horizontal roof, but also as a vertical wall.

What is claimed is:

1. A weather protection device, comprising at least one foldable protection component having a plurality of swivelling shafts and a non-circular tarpaulin attached to one of the plurality of shafts; and an adjustable mounting device for supporting the at least one protection component in a predetermined position, wherein the mounting device includes operating means for rotating the at least one protection component in an unfolded condition thereof around at least one of a vertical axle and horizontal axles for effecting at least one of adjusting a height of the at least one protection component, setting the at least one protection component at an angle, adjusting the at least one protection component transversely around an axis provided in a middle between two of the plurality of shafts, and a partial unfolding of tarpaulin by using at least one takeup yoke thereof.

2. A device according to claim 1, wherein the operating means comprises a node component to which each of the shaft is connected at an inner end thereof with a possibility of swivelling horizontally, and an adjusting mechanism connected with the node component for operating same.

3. A device according to claim 2, wherein the adjustment mechanism has at least one worm gear connected with the node component for swivelling the node component.

4. A device according to claim 2, wherein the adjusting mechanism comprises at least one movement mechanism for linearly displacing the node component.

5. A device according to claim 4, wherein the movement mechanism comprises a rotatable threaded rod and a nut associated with the node component.

6. A device according to claim 1, wherein the mounting device comprises means for stowing the at least one protection component, in a folded state thereof, at least one of vertically and horizontally.

7. A device according to claim 1, wherein the at least one take-up yoke has, in a vertical direction approximately in a middle thereof, a joint operatively connected with at least one of the shafts of the at least one protection component, whereby the at least one take-up yoke can swivel upon swivelling of the at least one of the shafts.

8. A device according to claim 7, wherein the at least one take-up yoke has opposite outer ends connected with respective shafts of the at least one protection component.

9. A device according to claim 7, wherein one of opposite ends of the at least one take-up yoke is connected with one of the shafts of the at least one protection component and another of the opposite ends of the at least one take-up yoke is connected with an intermediate shaft of the at least one protection component and arranged between two of the plurality of shafts of the at least one protection component, whereby the at least one protection component can be unfolded partially.

10. A device according to claim 3, wherein the mounting device comprises a plurality of take-up yokes for unfolding the at least one protection component in sections.

11. A device according to claim 7, further comprising a torsion spring positioned about the joint for preloading the at least one take-up yoke, and adjusting means for displacing the at least one take-up yoke to a non-preloaded position.

12. A device according to claim 11, wherein the adjusting means comprises one of rope hoist and a worm gear attached to the at least one take-up yoke.

* * * * *